US006438980B1

(12) United States Patent
Sakurai et al.

(10) Patent No.: US 6,438,980 B1
(45) Date of Patent: Aug. 27, 2002

(54) REFRIGERATING APPARATUS, REFRIGERATOR, AIR-COOLED TYPE CONDENSER UNIT FOR REFRIGERATING APPARATUS AND COMPRESSOR UNIT

(75) Inventors: Takashi Sakurai; Hideo Takemoto, both of Shimizu (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/941,705

(22) Filed: Aug. 30, 2001

Related U.S. Application Data

(63) Continuation of application No. 09/797,939, filed on Mar. 5, 2001, now Pat. No. 6,311,508, which is a continuation of application No. 09/464,764, filed on Dec. 16, 1999, now Pat. No. 6,220,044, which is a continuation of application No. 09/044,168, filed on Mar. 19, 1998, now Pat. No. 6,009,715.

(30) Foreign Application Priority Data

Mar. 19, 1997 (JP) ..... 9-66077

(51) Int. Cl.[7] ..... F25B 41/04

(52) U.S. Cl. ..... 62/197; 62/503; 62/505; 62/509; 62/513

(58) Field of Search ..... 62/503, 505, 509, 62/513, 474, 506, 507, 197

(56) References Cited

U.S. PATENT DOCUMENTS

| | | | | |
|---|---|---|---|---|
| 4,683,726 A | 8/1987 | Barron | 62/503 | |
| 5,222,378 A | 6/1993 | Chuan | 62/503 X | |
| 5,243,827 A | 9/1993 | Hagita et al. | 62/505 X | |
| 5,685,163 A | 11/1997 | Fujita et al. | 62/211 | |
| 5,813,249 A | 9/1998 | Matsuo et al. | 62/509 | |
| 6,009,715 A | 1/2000 | Sakurai et al. | 62/197 | |

FOREIGN PATENT DOCUMENTS

| | | |
|---|---|---|
| CN | 1132849 | 10/1996 |
| JP | 08086516 | 4/1996 |
| JP | 08159568 | 6/1996 |
| TW | 229789 | 9/1994 |

*Primary Examiner*—Harry B. Tanner
(74) *Attorney, Agent, or Firm*—Antonelli, Terry, Stout & Kraus, LLP

(57) ABSTRACT

In a refrigerating apparatus using an HFC group refrigerant, the. performance is improved by increasing the refrigerating capacity and a stable operation is made possible. In order to achieve this, a cycle system in a refrigerator is structured so as to connect a compressor, a condenser, a liquid receiver and a supercooler in this order. In an air-cooled separation type refrigerator, the liquid receiver is disposed within an air-cooled type condenser unit. Further, in the case where a flush gas is liable to be generated in a liquid pipe, a vapor-liquid separator is disposed within the compressor unit integral with an accumulator and separated therefrom by a partition plate.

10 Claims, 3 Drawing Sheets

REFRIGERATING APPARATUS, REFRIGERATOR, AIR-COOLED TYPE CONDENSER UNIT FOR REFRIGERATING APPARATUS AND COMPRESSOR UNIT

This is a continuation application of U.S. Ser. No. 09/797,939, filed Mar. 5, 2001 (now U.S. Pat. No. 6,311, 508), which is a continuation application of U.S. Ser. No. 09/464,764, filed Dec. 16, 1999 (now U.S. Pat. No. 6,220, 044), which is a continuation application of U.S. Ser. No. 09/044,168, filed Mar. 19, 1998 (now U.S. Pat. No. 6,009, 715).

BACKGROUND OF THE INVENTION

The present invention relates to a refrigerating apparatus which uses a Hydro Fluoro Carbon (hereinafter, referred to as HFC) group refrigerant, a refrigerating apparatus unit, an air-cooled type condenser unit and a compressor unit for a refrigerating apparatus, and, more particularly, the invention relates to a refrigerating apparatus which has an improved performance due to a stable operation and an increased refrigerating capacity.

A conventional refrigerating apparatus, for example, is described in Japanese Patent Unexamined Publication No. 8-159568, in the form of an air-cooled separate type refrigerating apparatus comprising a compressor unit and a separately provided air-cooled type condenser unit, and in which a liquid receiver is disposed within the air-cooled type condenser unit.

The conventional apparatus mentioned above is merely directed to a miniaturization of the compressor unit, provision of a sufficient of a service space and a prevention against lowering of the cooling performance of the liquid injection, but does not take into consideration the use of an HFC group pseudo-azeotropic mixture refrigerant, which has no influence on the earth's ozone layer. Further, since a discharge port for the liquid injection is formed within the low pressure side device, there is a risk that the piping system will become complex in correspondence to the kind of low pressure side device to be connected thereto.

SUMMARY OF THE INVENTION

An object of the present invention is to provide a refrigerating apparatus using an HFC group refrigerant in which a condensed HFC group liquid refrigerant is prevented from becoming a flush gas midway of a pipe leading to an expansion valve from the condenser and which is able to achieve a stable operation and an increase in refrigerating capacity.

Another object of the invention is to provide a compact compressor unit and to reduce the space required therefor, in an air-cooled separate type refrigerator, which refrigerator is constituted by a compressor unit and an air-cooled type condenser unit.

A further object of the invention is to make it possible to make the degree of supercooling of the HFC group liquid refrigerant greater and to prevent a non-condensed gas from mixing into the liquid refrigerant introduced to a low pressure side device or to a liquid injection line.

A still further object of the invention is to make the piping system of the refrigerating apparatus simple.

In order to achieve the above objects, in accordance with a first aspect of the invention, there is provided a refrigerating apparatus having a pipe for circulating an HFC group pseudo-azeotropic mixture refrigerant or azeotropic mixture refrigerant in a closed manner using a compressor, a condenser for condensing the refrigerant discharged from the compressor, a liquid receiver to which the refrigerant from the condenser is supplied, a supercooler for further cooling the liquid refrigerant from the liquid receiver, an expansion valve for decompressing and expanding the refrigerant from the supercooler, and an evaporator for evaporating the refrigerant supplied from the expansion valve.

In accordance with a second aspect of the invention, there is provided a refrigerating apparatus having a pipe for circulating an HFC group refrigerant, such as an R404A and an R507A, in a closed manner using a scroll compressor, a condenser for condensing the HFC group refrigerant discharged from the scroll compressor, a liquid receiver to which the HFC group refrigerant from the condenser is supplied, a pipe for taking out only an HFC group liquid refrigerant having a dryness of 0 from the liquid receiver and feeding it to-a supercooler, an expansion valve for expanding the HFC group refrigerant from the supercooler, an evaporator for evaporating the HFC group refrigerant supplied from the expansion valve, an accumulator connected between the evaporator and the scroll compressor, and a liquid injection line for injecting liquid refrigerant passing between the condenser and the expansion valve to an intermediate pressure chamber in the scroll compressor.

Incidentally, in the structure mentioned above, it is also preferable to provide a crier for removing wafer mixed within the refrigerant and a sight glass capable of observing the flow state of the refrigerant in the refrigerant pipe extending between the supercooler and the expansion valve, and to provide the liquid injection line in such a manner as to inject the liquid refrigerant passing between the drier and the sight glass to the scroll compressor.

In accordance with a third aspect of the invention, there is provided a refrigerator having a compressor and a condenser, a refrigerant pipe for feeding an HFC group pseudo-azeotropic mixture refrigerant from the compressor to the condenser, a liquid receiver to which the refrigerant from the condenser is supplied, a supercooler for further cooling only the liquid refrigerant taken out from the liquid receiver, a refrigerant pipe for feeding the refrigerant from the supercooler to a low pressure side device, a liquid injection line for injecting a part of the liquid refrigerant in the refrigerant pipe to a compressing chamber in the compressor, and a refrigerant pipe for feeding the refrigerant from the low pressure side device to the compressor.

In accordance with a fourth aspect of the invention, there is provided a refrigerator having a scroll compressor and a condenser, a pipe for feeding an HFC group pseudo-azeotropic mixture refrigerant, such as R404A and an R507A, compressed by the scroll compressor, to the condenser, a liquid receiver to which the refrigerant from the condenser is supplied, a refrigerant pipe for taking out only liquid refrigerant having a dryness of 0 from the liquid receiver and feeding it to a supercooler, a refrigerant pipe for feeding the refrigerant from the supercooler to a low pressure side device, a drier provided in the refrigerant pipe for removing water mixed within the refrigerant and a sight glass capable of observing the state of flow of the refrigerant, a liquid injection fine for injecting the liquid refrigerant flowing between the drier and the sight glass to an intermediate compressing chamber of the scroll compressor, a refrigerant pipe for feeding refrigerant from the low pressure side device to the compressor via an accumulator.

In accordance with a fifth aspect of the invention, there is provided an air-cooled type condenser unit for a refrigerating apparatus having a condenser and a cooling fan, a refrigerant pipe for feeding an HFC group pseudo-azeotropic mixture refrigerant from the compressor unit to the condenser, a liquid receiver to which the refrigerant from the condenser is supplied, a supercooler for further cooling only liquid refrigerant taken out from the liquid receiver, and a refrigerant pipe for feeding the refrigerant from the supercooler to the compressor unit.

In accordance with a sixth aspect of the invention, there is provided a compressor unit for a refrigerating apparatus having a scroll compressor, a pipe for feeding an HFC group pseudo-azeotropic mixture refrigerant, such as an R404A and an R507A, compressed by the scroll compressor, to a condenser of an air-cooled type condenser unit for a refrigerating apparatus, a refrigerant pipe for supplying the refrigerant from the condenser unit to a low pressure side device, a drier provided in the refrigerant pipe for removing water mixed within the refrigerant, a liquid injection line for injecting the liquid refrigerant in the refrigerant pipe downstream of the drier to an intermediate compressing chamber of the scroll compressor, an electromagnetic valve and an electronic expansion valve which are disposed in the liquid injection line, a refrigerant pipe for feeding refrigerant from the low pressure side device to the scroll compressor via an accumulator.

In accordance with a seventh aspect of the invention, there is provided a compressor unit for a refrigerating apparatus having a scroll compressor, a pipe for feeding a refrigerant compressed by the scroll compressor to a condenser in an air-cooled type condenser unit for the refrigerating apparatus, a refrigerant pipe for supplying the refrigerant from the condenser unit to a low pressure side device, a vapor-liquid separator connected in the refrigerant pipe, a liquid injection line for injecting liquid refrigerant from a point downstream of the vapor-liquid separator to an intermediate compressing chamber of the scroll compressor, an electromagnetic valve and an electronic expansion valve which are disposed in the liquid injection line, a refrigerant pipe for feeding the refrigerant from the low pressure side device to the scroll compressor via an accumulator, the accumulator and the vapor-liquid separator being integrally constructed, and the refrigerant within the vapor-liquid separator being cooled by the refrigerant within the accumulator.

Incidentally, when the air-cooled type condenser unit for the refrigerating apparatus mentioned above is disposed outdoors and the compressor unit for the refrigerating apparatus mentioned above is disposed indoors and is connected by a pipe, an air-cooled separation type refrigerator can be obtained, and, further, when the low pressure side device having an expansion valve and an evaporator is connected thereto, the refrigerating apparatus can be constructed.

In accordance with an eighth aspect of the invention, there is provided a refrigerator having a scroll compressor and a condenser, a pipe for feeding an HFC group pseudo-azeotropic mixture refrigerant, such as an R404A and an R507A, compressed by the scroll compressor, to the condenser, a liquid receiver to which the refrigerant from the condenser is supplied, a refrigerant pipe for taking out only a liquid refrigerant having a dryness of 0 from the liquid receiver and feeding it to a supercooler, a refrigerant pipe for feeding the refrigerant from the supercooler to a low pressure side device, a vapor-liquid separator connected to the refrigerant pipe, a drier provided in the refrigerant pipe downstream of the vapor-liquid separator for absorbing and removing water mixed within the refrigerant, a sight glass provided in the refrigerant pipe disposed downstream of the drier for observing the state of the flow of refrigerant and any water contained within the refrigerant, a liquid injection line for injecting liquid refrigerant flowing between the drier and the sight glass to an intermediate compressing chamber in the scroll compressor, an electromagnetic valve and an electronic expansion valve which are provided in the liquid injection line, a refrigerant pipe for feeding refrigerant from the low pressure side device to the scroll compressor via an accumulator, the accumulator and the vapor-liquid separator being integrally constructed, and the refrigerant within the vapor-liquid separator being cooled by the refrigerant within the accumulator.

That is to say, in accordance with the respective characteristics mentioned above, since the HFC group pseudo-azeotropic mixture refrigerant, such as R404A and R507A, is used and the cycle system is constructed by connecting the compressor, the condenser, the liquid receiver and the supercooler in this order, the liquid refrigerant is sufficiently condensed, for example, and a liquid refrigerant having a dryness of 0 can be introduced to the supercooler, so that the heat transmission efficiency in the supercooler can be significantly improved.

Further, since the air-cooled condenser portion is disposed outdoors as an air-cooled type condenser unit, the compressor portion is disposed indoors as a compressor unit, to thereby construct the air-cooled separation type refrigerating apparatus, and since the liquid receiver is disposed within the air-cooled type condenser unit side, the three liquid pipes which are provided between the compressor unit and the air-cooled type condenser unit in the conventional system having the liquid receiver in the compressor unit side can be reduced to one liquid pipe in accordance with the invention. Further, since no liquid receiver exists within the compressor unit, the compressor unit can be made compact, so that the space required for disposing the compressor unit within the machine room, etc. can be greatly reduced.

Still further, since a compressor unit having an accumulator and an air-cooled condenser unit haying a liquid receiver (a first liquid receiver) temporarily storing the liquefied refrigerant are provided, the compressor unit and the air-cooled type condenser unit can be constructed as an air-cooled separation type refrigerating system in which the units are separated, the liquid receiver (a second liquid receiver) for separating the vapor from the liquid can be provided within the compressor unit, and the liquid receiver and the accumulator within the compressor unit can be integrally constructed while being separated by a partition plate, and the supercooling degree, of the liquid refrigerant can be made large.

Furthermore, in the apparatus in which the discharge port of the liquid injection line is disposed within the refrigerator or in the refrigerant pipe within the compressor unit, no matter what kind of low pressure side device is connected to the refrigerator, a complex pipe system is not required.

Other characteristics, objects and advantages of the invention will be clarified by the following description with reference to the attached drawings.

DESCRIPTION OF PREFERRED EMBODIMENTS

In the use of an HFC (Hydro Fluoro Carbon) group pseudo-azeotropic mixture refrigerant in a refrigerating apparatus, such as R404A and R507A, it is difficult to supercool the condensed liquid refrigerant due to the physical property of the refrigerant in comparison with a conventional HCFC refrigerant, such as R22; and, in the case of R404A, for example, about twice the heat exchanging amount is necessary for obtaining the same supercooling degree as that of the R22.

On the other hand, the latent heat of vaporization of R404A is about 70% of that of R22, so that the refrigerating capacity can be increased by setting the supercooling degree to as large a value as possible. Further, in the liquid injection method of cooling a discharged gas by a compressor to a condensed liquid refrigerant, it is important to the reliability for a stable supercooled liquid to be supplied to an intermediate pressure portion (a compression chamber) of the compressor.

Accordingly, in the use of a HFC near pseudo-azeotropic mixture refrigerant, it is significantly important for improving the reliability and increasing the refrigerating capacity to sufficiently supercool the condensed liquid.

An embodiment of the invention will be described below with reference to the attached drawings.

Figure 1:
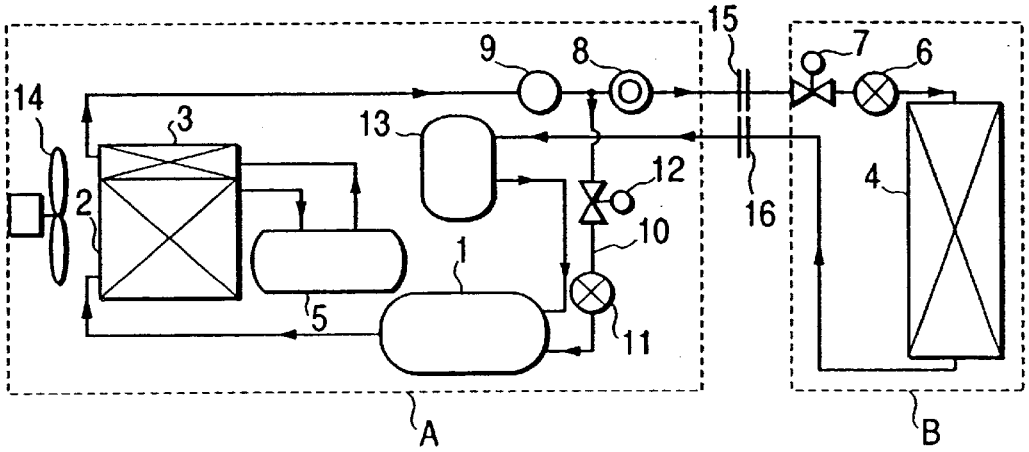
FIG. 1 is a schematic diagram which shows a basic refrigerating cycle of a refrigerating apparatus in accordance with an embodiment of the invention.

FIG. 1 is a schematic diagram which illustrates a basic refrigerating cycle of a refrigerating apparatus in accordance with an embodiment of the invention. In the drawing, reference symbol A denotes an air-cooled and integral type refrigerator (a condenser unit), in which a condenser is cooled by the use of air, and having a compressor and an accumulator within a container; reference symbol B denotes a low pressure side device (an evaporator unit) having an evaporator and an expansion valve; and the refrigerator A and the low pressure side device B are connected by pipe connecting portions 15 and 16, thereby constituting a refrigerating cycle.

An example of the structure of the refrigerating apparatus shown in FIG. 1 will be described in further detail. Reference numeral 1 denotes a scroll compressor, reference numeral 2 denotes a condenser disposed downstream of the scroll compressor and reference numeral 3 denotes a supercooler integrally constructed with the condenser 2. A gas refrigerant, such as R404A and R507A, discharged from the compressor 1 is cooled by a cooling fan 14 in the condenser 2 and. is condensed to become a liquid refrigerant. The apparatus is structured such that the liquid refrigerant once condensed is temporarily stored in a liquid receiver 5, and thereafter, only a liquid refrigerant having a dryness of 0 is taken out from the liquid receiver and is introduced to the supercooler 3, where it is supercooled.

The liquid refrigerant supercooled in the supercooler 3 passes through a drier (a water removing apparatus for absorbing and removing water contained in the refrigerant) 9 disposed within the refrigerator A and a sight glass (means for observing the flow state of the refrigerant) 8, flows to the low pressure side device B through the pipe connecting portion 15, flows to an electromagnetic valve 7, an expansion valve 6 and an evaporator 4 so as to be evaporated, flows to the refrigerator A side through the pipe connecting portion 16 after again becoming a gas refrigerant, and is sucked to the compressor 1 after passing through an accumulator 13. The sight glass 8 is structured to make it possible not only to observe the flow state of the refrigerant, but also to observe water contained in the refrigerant, and is also provided with an indicator which charges color when the amount of water exceeds a fixed amount.

The refrigerant pipe between the drier 9 and the sight glass 8 and an intermediate pressure chamber (a compressing chamber) of the scroll compressor 1 are connected to each other by a liquid injection pipe 10, and an electromagnetic valve 12 and an electronic expansion valve 11 for controlling the liquid injection amount are provided in the liquid injection pipe 10. By including the liquid injection line, it is possible for the liquid refrigerant to be injected to the intermediate compressing chamber of the scroll compressor 1 so that the discharge gas temperature of the scroll compressor 1 is kept at a temperature equal to or less than an allowable value by cooling the compressed gas. Incidentally, the drier 9 has a function also as a filter, and dust is prevented from flowing to the electronic expansion valve 11 by connecting the liquid injection line downstream thereof, thereby protecting the electronic expansion valve 11.

Further, the electromagnetic valve 12 is controlled in such a manner as to be closed when the compressor 1 is stopped, thereby preventing the electronic expansion valve 11 from being fully closed every time the compressor is temporarily stopped during operation of the refrigerator, so that the life of the electronic expansion valve 11 can be extended. That is to say, because there is a characteristic that the electronic expansion valve has a limitation in the frequency at which it is capable of being fully closed, when the frequency at which it is fully closed is increased, the life thereof becomes short correspondingly.

Incidentally, another portion of the liquid injection line than the portion mentioned above can be employed to supply liquid refrigerant to the compressor 1 so long as it can take out the liquid refrigerant. For example, the liquid refrigerant can be taken out from a liquid refrigerant pipe within the liquid receiver 5 or at the downstream side of the supercooler 3.

In accordance with this embodiment, since the cycle system is structured so as to connect the compressor, the condenser, the liquid receiver and the supercooler in this order and to introduce liquid refrigerant having a dryness of 0 to the supercooler from the liquid receiver, the heat transmission efficiency in the supercooler can be significantly improved, the HFC group pseudo-azeotropic mixture refrigerant, such as R404A and R507A, which is hard to supercool, can be sufficiently supercooled, a stable operation can be performed even by using this kind of new refrigerant, and an improvement in performance due to an increase in refrigerating capacity becomes possible as well.

Figure 2:
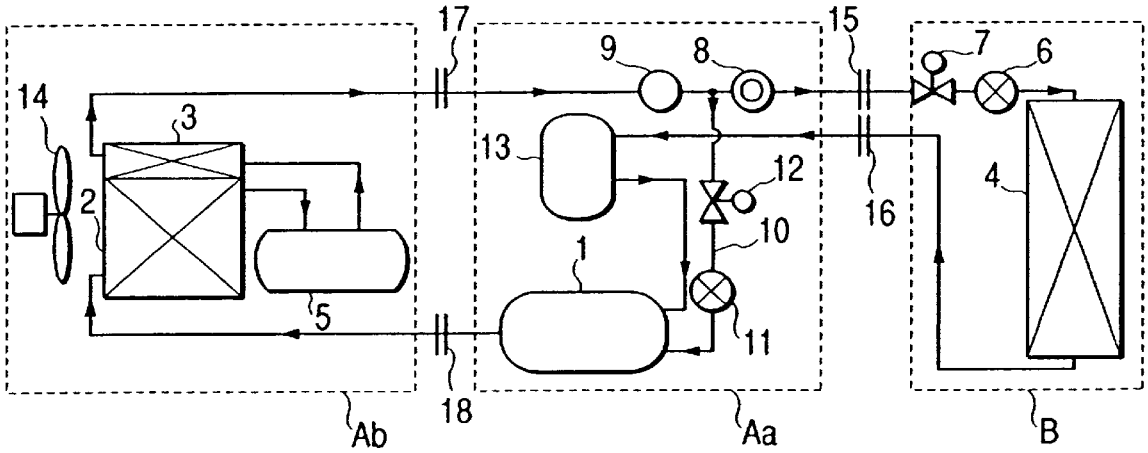
FIG. 2 is a schematic diagram which shows a refrigerating cycle in accordance with an embodiment of the invention in the case of an air-cooled separation type refrigerator.

FIG. 2 shows an embodiment in which the refrigerator is of the air-cooled separation type. The air-cooled separation type refrigerator is constituted by a compressor unit Aa and an air-cooled type condenser unit Ab, and is connected to the low pressure side device B by way of the pipe connection portions 15 and 16 in the same manner as that of FIG. 1, while the units Aa and Ab are connected by way of the pipe connecting portions 17 and 18, thereby constituting a refrigerating cycle.

The condenser 2, the supercooler 3, the liquid receiver 5 and the cooling fan 14 are disposed within the air-cooled condenser unit Ab; the scroll compressor 1 and the accumulator 13 are disposed within the compressor unit Aa; and the liquid injection line is provided in the same manner as in the embodiment of FIG. 1.

As mentioned above, in the air-cooled separation type refrigerator in which the refrigerator is constituted by a compressor unit and an air-cooled type condenser unit, no liquid receiver exists within the compressor unit, since the liquid receiver is disposed within the air-cooled condenser unit, so that the compressor unit can be made more compact. The compressor unit is generally disposed in a machine room, and so, in accordance with this embodiment, the space in the machine room needed for the compressor unit can be largely reduced. Further, it is also possible for the compressor unit to be disposed within the low pressure side device, however, in this case. the effective space within the low pressure side device will need to be enlarged; however, the ability to service the equipment can be improved.

Figure 3:
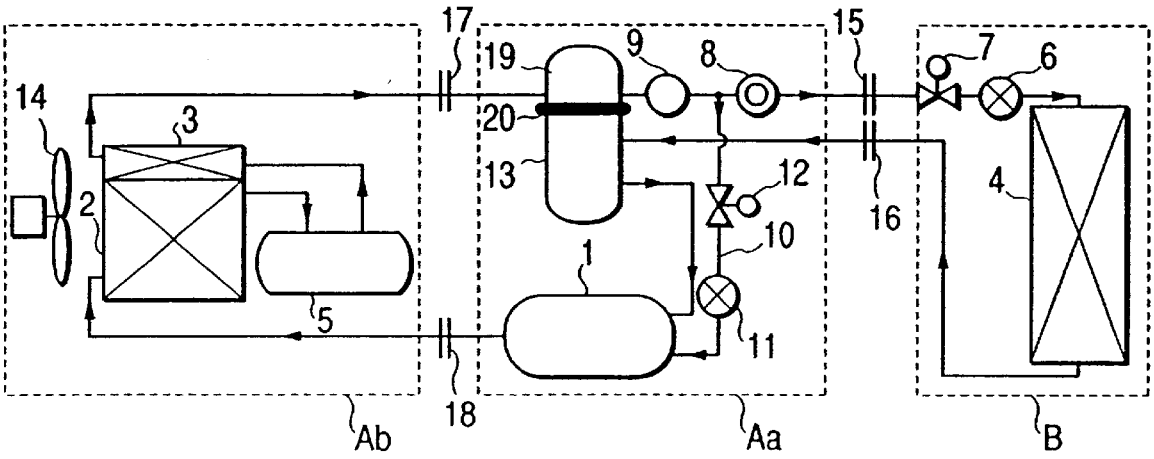
FIG. 3 is a schematic diagram which shows a refrigerating cycle in accordance with another embodiment of the invention in the case of an air-cooled separation type refrigerator.

FIG. 3 shows substantially the same structure as that of FIG. 2, which corresponds to an embodiment in which the refrigerator is of the air-cooled separation type. The air-cooled separation type refrigerator is constituted by a compressor unit Aa and an air-cooled type condenser unit Ab. The air-cooled type condenser unit Ab is the same as that of FIG. 2, however, the compressor unit Aa is integrally provided with a vapor-liquid separator (a second liquid receiver) 19 in an upper portion of the accumulator 13 separated by a partition plate 20, which is a feature of this embodiment. The other structure is the same as that of FIG. 2.

As mentioned above, the vapor-liquid separator is disposed within the compressor unit in the refrigerator, and the vapor-liquid separator is integrally constructed with the accumulator, being separated by way of a partition plate, so as to further cool the liquid refrigerant from the supercooler 3 using the refrigerant gas from the evaporator, which has a low temperature, so that the degree of supercooling of the liquid refrigerant can be made greater, thereby preventing a non-condensed gas from being mixed with the liquid refrigerant introduced to the low pressure side device B or the liquid injection line 10.

This embodiment is particularly effective in the case where the compressor unit and the condenser unit are disposed apart from each other and the length of the connection pipe therebetween is made long. In the case where a pressure loss in the liquid pipe becomes large and a flush gas is easily generated, a stable operation still can be obtained by providing the vapor-liquid separator (the second receiver) within the compressor unit.

Figure 4:
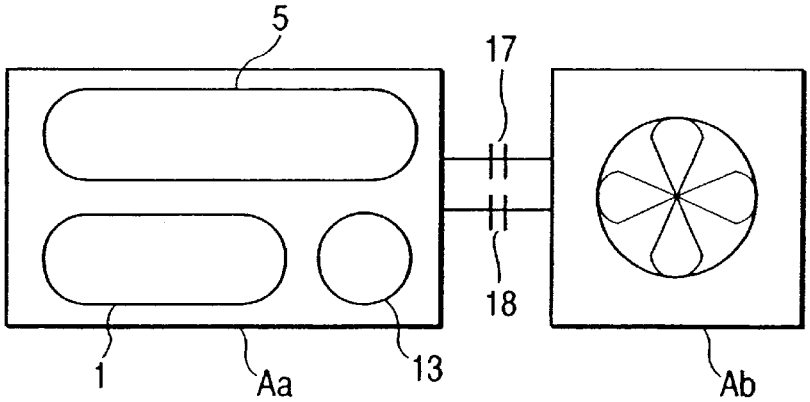
FIG. 4 is a plan view which shows a basic arrangement of an air-cooled separation type refrigerator.
Figure 5:
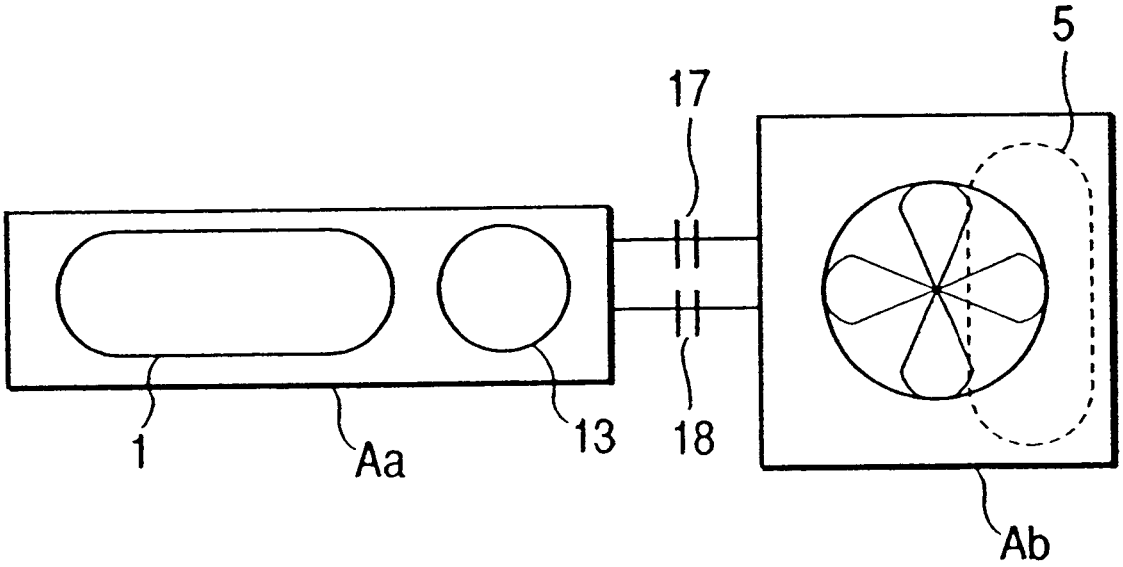
FIG. 5 is a plan view which shows a structural arrangement of an air-cooled separation type refrigerator in accordance with the invention.

FIGS. 4 and 5 respectively show embodiments of device the air-cooled separation type refrigerator.

Conventionally, as shown in FIG. 4, the scroll compressor 1, the liquid receiver 5 and the accumulator 13 are generally disposed in the compressor unit Aa in the manner shown in the drawings, and the compressor unit Aa is connected to the air-cooled type condenser unit Ab by way of the pipe connecting portions 17 and 18. In comparison with this, in accordance with the invention, as shown in FIG. 5, the scroll compressor 1 and the accumulator 13 are disposed in the compressor unit Aa, and the liquid receiver 5 is disposed within the air-cooled type condenser unit Ab, as shown in the drawing, not in the compressor unit Aa.

As mentioned above, since the liquid receiver is moved within the air-cooled type condenser unit, the compressor unit can be mace compact, and further, as shown in the drawing, since the liquid receiver can be disposed in a de ad space within the air-cooled type condenser unit, the air-cooled type condenser unit itself is not enlarged, so that the total size of the refrigerator can be made compact.

In accordance with the invention, the cycle system is structured so as to connect the compressor, the condenser, the liquid receiver and the supercooler in this order and to introduce the liquid refrigerant, for example, having a dryness of 0, to the supercooler from the liquid receiver, so that the heat transmission efficiency in the supercooler can be significantly improved, and a sufficient supercooling can be given to the HFC group pseudo-azeotropic mixture refrigerant, which is hard to supercool. Accordingly, even when a HFC group pseudo-azeotropic refrigerant is used, a stable operation without generation of a flush gas can be performed, so that the performance can be improved by increasing a refrigerating capacity. Particularly, in the case where a liquid injection line to the compressor is also provided, even when the HFC group pseudo-azeotropic mixture refrigerant is used, the liquid refrigerant can be stably supplied to the liquid injection line, so that the performance can be more stably improved.

Further, in an air-cooled separation type refrigerator in which the refrigerator is constituted by a compressor unit and an air-cooled type condenser unit, since the liquid receiver is disposed within the air-cooled condenser unit, no liquid receiver exists within the compressor unit, so that the compressor unit can be made more compact.

Still further, in the structure having a vapor-liquid separator disposed within the compressor unit of the air-cooled separation type refrigerator, integrally constructed with the accumulator and separated by means of a partition plate, for performing a heat exchange between the liquid refrigerant and the gas refrigerant, the degree of supercooling of the liquid refrigerant can be greater, thereby preventing a non-condensed gas from being mixed with the liquid refrigerant introduced to the low pressure side device or the liquid injection line.

Furthermore, when the discharge port of the liquid injection line is disposed within the refrigerator or in the refrigerant pipe within the compressor unit, no matter what kind of low pressure side device is connected to the refrigerator, the pipe system is never made complex.

What is claimed is:

1. An air-cooled type condenser unit for a refrigerating apparatus comprising a compressor, a condenser, a cooling fan for cooling said condenser, a first refrigerant pipe for feeding refrigerant from said compressor to said condenser, a liquid receiver to which refrigerant from said condenser is supplied, a supercooler for further cooling refrigerant taken out from said liquid receiver, a second refrigerant pipe for feeding refrigerant from said supercooler towards a low pressure side device; and a liquid injection line for injecting liquid refrigerant flowing in said second refrigerant pipe downstream of said supercooler to a compressing chamber of said compressor, wherein said liquid injection line includes an electromagnetic valve and an expansion instrument, and said electromagnetic valve is controlled to be closed when said compressor is stopped.

2. The air-cooled type condenser unit of claim 1 wherein the electromagnetic valve is installed upstream of the expansion instrument within the liquid injection line.

3. A refrigerator having a compressor, a pipe for circulating an HFC group refrigerant, selected from a group consisting of R404A and R507A, in a closed manner by said compressor, a condenser for condensing HFC group refrigerant discharged from said compressor, a liquid receiver to which HFC group refrigerant from the condenser is supplied, a pipe for taking out only HFC group liquid refrigerant having a dryness of 0 from said liquid receiver and feeding it to a supercooler, an accumulator disposed in a refrigerant pipe for feeding refrigerant from a low pressure side device to said compressor, and a liquid injection line for injecting a part of the liquid refrigerant in said refrigerant pipe downstream of said condenser to a compressing chamber in said compressor, wherein said liquid injection line includes an electromagnetic valve and an expansion instrument, and said electromagnetic valve is controlled to be closed when said compressor is stopped.

4. An air-cooled type condenser unit for a refrigerating apparatus comprising a compressor, a condenser, a cooling fan for cooling said condenser, a first refrigerant pipe for feeding a refrigerant from said compressor to said condenser, a liquid receiver to which refrigerant from said condenser is supplied, a second refrigerant pipe for feeding refrigerant from said liquid receiver towards a low pressure side device;

a sight glass capable of observing the flow state of the refrigerant in said second refrigerant pipe, and a liquid injection line for injecting liquid refrigerant flowing in said second refrigerant pipe upstream of said sight glass to a compressing chamber of said compressor, wherein said liquid injection line includes an electromagnetic valve and an expansion instrument, and said electromagnetic valve is controlled to be closed when said compressor is stopped.

5. A refrigerator having a compressor, a pipe for circulating an HFC group refrigerant, selected from a group consisting of R404A and R507A, in a closed manner by said compressor, a condenser for condensing HFC group refrigerant discharged from said compressor, a liquid receiver to which HFC group refrigerant from the condenser is supplied, an accumulator disposed in a refrigerant pipe for feeding refrigerant from a low pressure side device to said compressor, a sight glass capable of observing the flow state of the refrigerant in a refrigerant pipe for taking out HFC group liquid refrigerant from said liquid receiver and feeding it to a low pressure side device, and a liquid injection line for injecting liquid refrigerant flowing in a refrigerant pipe upstream of said sight glass to a compressing chamber of said compressor, and a valve and an expansion instrument provided in said liquid injection line wherein said liquid injection line includes an electromagnetic valve and an expansion instrument, and said electromagnetic valve is controlled to be closed when said compressor is stopped.

6. A refrigerator having a compressor, a refrigerant pipe for circulating an HFC group refrigerant, selected from a group consisting of R404A and R507A, in a closed manner by said compressor, a condenser for condensing HFC group refrigerant discharged from said compressor, a liquid receiver to which HFC group refrigerant from the condenser is supplied, an accumulator disposed in a refrigerant pipe for feeding refrigerant from a low pressure side device to said compressor, and a liquid injection line for injecting a part of the liquid refrigerant in said refrigerant pipe downstream of said condenser to a compressing chamber in said compressor, wherein said liquid injection line includes an electromagnetic valve and an expansion instrument, and said electromagnetic valve is controlled to be closed when said compressor is stopped.

7. A refrigerator having a scroll compressor, a condenser, a first refrigerant pipe for feeding refrigerant from said compressor to said condenser, a liquid receiver to which refrigerant from said condenser is supplied, a second refrigerant pipe for feeding refrigerant from said condenser to a low pressure side device, a third refrigerant pipe for feeding refrigerant from said low pressure side device to said compressor, and a liquid injection line for injecting a part of the liquid refrigerant in said second refrigerant pipe downstream of said liquid receiver to a compressing chamber in said compressor, wherein said liquid injection line includes an electromagnetic valve and an expansion instrument, said electromagnetic valve is controlled to be closed when said compressor is stopped, and said refrigerant is an HFC group pseudo-azeotropic mixture refrigerant selected from the group consisting of R404A and R507A.

8. An air-cooled type condenser unit for a refrigerating apparatus comprising a scroll compressor, a condenser, a cooling fan for cooling said condenser, a first refrigerant pipe for feeding a refrigerant from said compressor to said condenser, a second refrigerant pipe for feeding refrigerant from said condenser toward a low pressure side device; and a liquid injection line for injecting liquid refrigerant flowing in said second refrigerant pipe downstream of said condenser to a compressing chamber of said scroll compressor, wherein said liquid injection line includes an electromagnetic valve and an expansion instrument, said electromagnetic valve being controlled to be closed when said compressor is stopped, and said refrigerant is an HFC group pseudo-azeotropic mixture refrigerant selected from the group consisting of R404A and R507A.

9. An air-cooled type condenser unit according to claim 8, further comprising a liquid receiver to which refrigerant from said condenser is supplied, and a sight glass capable of observing the flow state of the refrigerant in said second refrigerant pipe, wherein said liquid injection line is connected between said liquid receiver and said sight glass in said second refrigerant pipe.

10. A refrigerator having a scroll compressor, a pipe for circulating an HFC group refrigerant, selected from a group consisting of R404A and R507A, in a closed manner by said scroll compressor, a condenser for condensing HFC group refrigerant discharged from said scroll compressor, and a liquid injection line for injecting liquid refrigerant flowing in a refrigerant pipe downstream of said condenser to a compressing chamber of said scroll compressor, and a valve and an expansion instrument provided in said liquid injection line, wherein said valve in said liquid injection line being controlled to be closed when said compressor is stopped.

* * * * *